US009192199B1

(12) United States Patent
Lodza

(10) Patent No.: US 9,192,199 B1
(45) Date of Patent: Nov. 24, 2015

(54) EYEGLASSES POCKET

(75) Inventor: Lloyd Dokwani Lodza, Elmont, NY (US)

(73) Assignee: LODZA, INC, Elmont, NY (US)

( * ) Notice: Subject to any disclaimer, the term of this patent is extended or adjusted under 35 U.S.C. 154(b) by 512 days.

(21) Appl. No.: 13/448,337

(22) Filed: Apr. 16, 2012

(51) Int. Cl.
*A41D 13/00* (2006.01)
*A41D 27/22* (2006.01)

(52) U.S. Cl.
CPC ..... *A41D 13/0015* (2013.01); *A41D 27/22* (2013.01)

(58) Field of Classification Search
CPC ..... A41B 1/08; A41B 1/00; A41B 9/06; A41B 11/00; A41B 11/003; A41B 13/08; A41B 17/00; A41B 1/10; A41B 2400/34; A41B 2400/36; A41B 2400/38; A41B 2400/60; A41B 7/02; A41B 9/00; A41B 9/12; A41B 2400/82; A41D 15/007; A41D 20/00; A41D 2200/20; A41D 2300/20; A41D 2300/322; A41D 2400/32; A41D 2400/34; A41D 2400/44; A41D 27/00; A41D 27/24; A41D 3/02; A41D 10/00; A41D 1/06; A41D 13/0015; A41D 1/00; A41D 15/00; A41D 1/04; A41D 27/08; A41D 13/0012; A41D 1/02; A41D 3/08; A41D 13/0058; A41D 1/002; A41D 1/005; A41D 27/20; A41D 13/00; A41D 13/12
USPC ..... 2/12, 69, 115, 244
See application file for complete search history.

(56) References Cited

U.S. PATENT DOCUMENTS

| | | | | |
|---|---|---|---|---|
| 4,062,064 | A | 12/1977 | Vosatka | |
| 4,179,753 | A * | 12/1979 | Aronberg et al. | 2/10 |
| 4,896,377 | A * | 1/1990 | Ferdi | 2/115 |
| 5,477,562 | A * | 12/1995 | Dixon | 2/250 |
| 5,509,147 | A * | 4/1996 | Busquets | 2/253 |
| 5,584,074 | A * | 12/1996 | Battle-Smith | 2/115 |
| 5,903,928 | A * | 5/1999 | Hyung-Seob | 2/244 |
| 6,161,224 | A * | 12/2000 | Tuetken | 2/244 |
| 6,247,177 | B1 * | 6/2001 | Hayes | 2/12 |
| 6,647,554 | B1 * | 11/2003 | Yan | 2/209.13 |
| D691,348 | S | 10/2013 | Glaze | |
| 2003/0154534 | A1 * | 8/2003 | Miller et al. | 2/69 |
| 2005/0022290 | A1 * | 2/2005 | Neaman | 2/271 |

OTHER PUBLICATIONS url: http://www.pilotshirts.com/4_FAQs.asp Title: Pilot Shirts—Frequently Asked Questions—Pilotshirts.com—Date: unknown. See p. 3 of pdf, these Questions: J—What is a pencil slot vs. A pencil stitch? K—How can I wear pilot wings on my shirt?
Badge Eyelets over wearer's left breast on a uniform dress, visible as two horizontally-aligned white-stitched horizontal eyelets. Date unknown. http://www.chefworks.com.hk/?page=shop/flypage_hk201008&product_id=1018&category=housekeeping_al-lhousekeeping&PHPSESSID=4blc67t33o7dihmt3gai75p8j6.

(Continued)

*Primary Examiner* — Clinton T Ostrup
*Assistant Examiner* — Catherine M Ferreira
(74) *Attorney, Agent, or Firm* — Nolte, Nolte & Hunter; Christopher B. Garvey

(57) ABSTRACT

A garment and pocket for temporarily securing and carrying a pair of eyeglasses on an upper part of a wearer's body. The garment, such as a shirt, has a pocket affixed to the garment, for receiving an eyeglasses temple and retaining the temple. One version of the invention has an angled pocket. A second version has a vertical pair holes to receive the temple.

10 Claims, 5 Drawing Sheets

(56) References Cited

OTHER PUBLICATIONS

Badge Eyelets on Pilot's shirt, obscured by badge Two pen-openings in pocket flaps' stitching, with a pen inserted in each opening. Date unknown. http://www.pilotshirts.com/1_MenShirts.asp.

Patch pocket on T-shirt. J.C. Rags Palm Tree Pocket T-Shirt from Nordstrom website. Date unknown. http://shop.nordstrorn.com/s/j-c-rags-palm-tree-pocket-t-shirt/3264204?origin=category.

In the Heat of the Night (1967) movie; Photo of Sidney Poitier, Warren Oates Flapped pocket near Warren Oates's badge appears to have a straight stitch separating a pen compartment from the rest of the pocket. Pens are inserted through a small un-stitched portion of the pocket flap over the pen compartment. http://www.imdb.com/media/rm2548480512/t10061811.

Old work-shirt from this attorney's closet, having a pen-opening in a pocket flap's stitching, with a pen inserted in the opening. No seam separates the pen from the rest of the pocket. Date of shirt is unknown, but probably from the previous millennium.

Man's white short-sleeve shirt, with stitching separating a thin pen compartment from the remainder of the pocket. This recent photo shows a pen in the pen compartment. Back lighting shows a pair of sunglasses in the main part of the pocket. From this attorney's closet. Date of shirt is unknown, but is prior to this patent application.

A pair of pen pockets on the sleeve of a shirt. Woolrich Mens Elite. Date unknown. From http://www.woolrich.com.

* cited by examiner

EYEGLASSES POCKET

FIELD OF INVENTION

The present invention relates to a means for temporarily securing a pair of eyeglasses to an article of clothing such as a shirt.

The preferred embodiment envisions an angled pocket.

An alternate embodiment envisions a pair of holes, formed similarly to button holes.

BACKGROUND OF THE INVENTION

Shirts and jackets often have pockets. Such conventional pockets may be used to secure and carry a pair of eyeglasses such as sunglasses and reading glasses.

THE PRESENT INVENTION

The present invention uses a means for cooperating with one of the temples of the pair of eyeglasses, to secure the eyeglasses to an article of clothing, such as a shirt.

A pair of eyeglasses generally have frames, a temple, a bend in the temple, and an earpiece on the temple.

In a first embodiment, the invention comprises a pocket, shaped with an angle that cooperates with the eyeglasses' temple and the temple's bend and earpiece, to snugly secure said temple to said shirt, and retain it in the pocket.

A second embodiment of the invention comprises a pair of horizontal holes, constructed like buttonholes, approximately ⅝ inch across their openings, and spaced approximately 3 inches apart. These holes are located in a continuous area of cloth, and supported by said continuous area of cloth.

These holes are not located at an edge of a garment opening, nor are they associated with buttons. These holes are not intended for buttons. However, in construction, the holes are preferably formed in the same way as buttonholes, either by:

conventional edge and corner buttonhole stitching, or old fashioned bindings or hem tapes at the edges and corners.

The continuous area of cloth extends laterally from the holes for at least three inches left and right, to support the holes firmly in the garment.

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

DETAILED DESCRIPTION OF THE DRAWINGS

Figure 1:
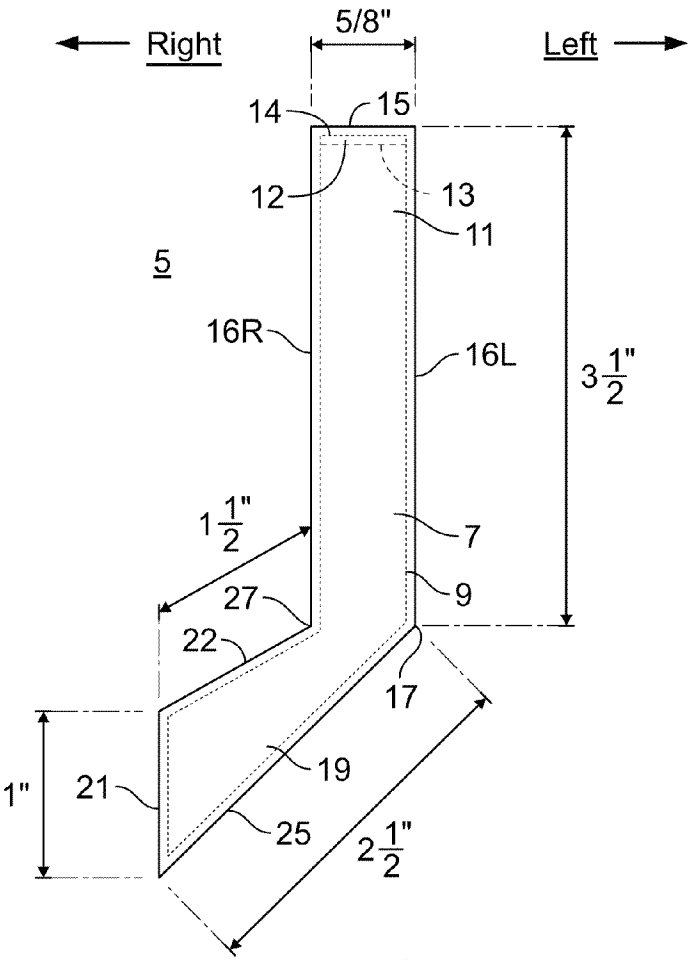
FIG. 1 is an elevation of a pocket used in the preferred embodiment the present invention.

FIG. 1 is an elevation showing shirt material, generally designated 5. Secured to this field of shirt material 5, is a pocket 7 used in the preferred embodiment the present invention.

Figure 7:
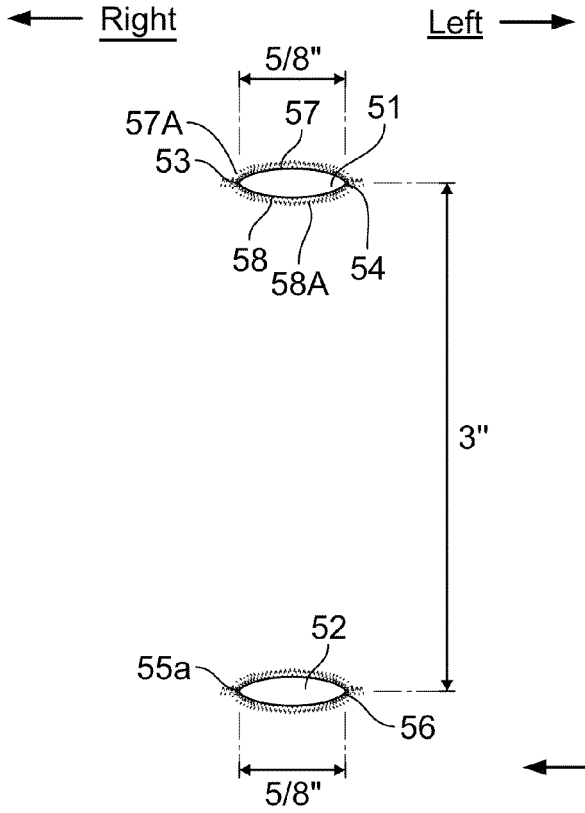
FIG. 7 is a detail of said holes.
Figure 8:
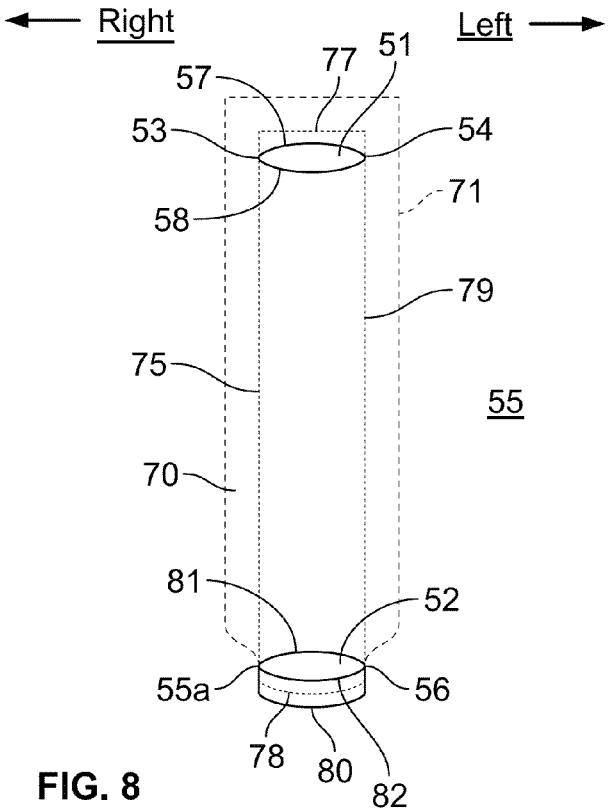
FIG. 8 is a similar detail of an alternative embodiment of said holes.
Figure 9:
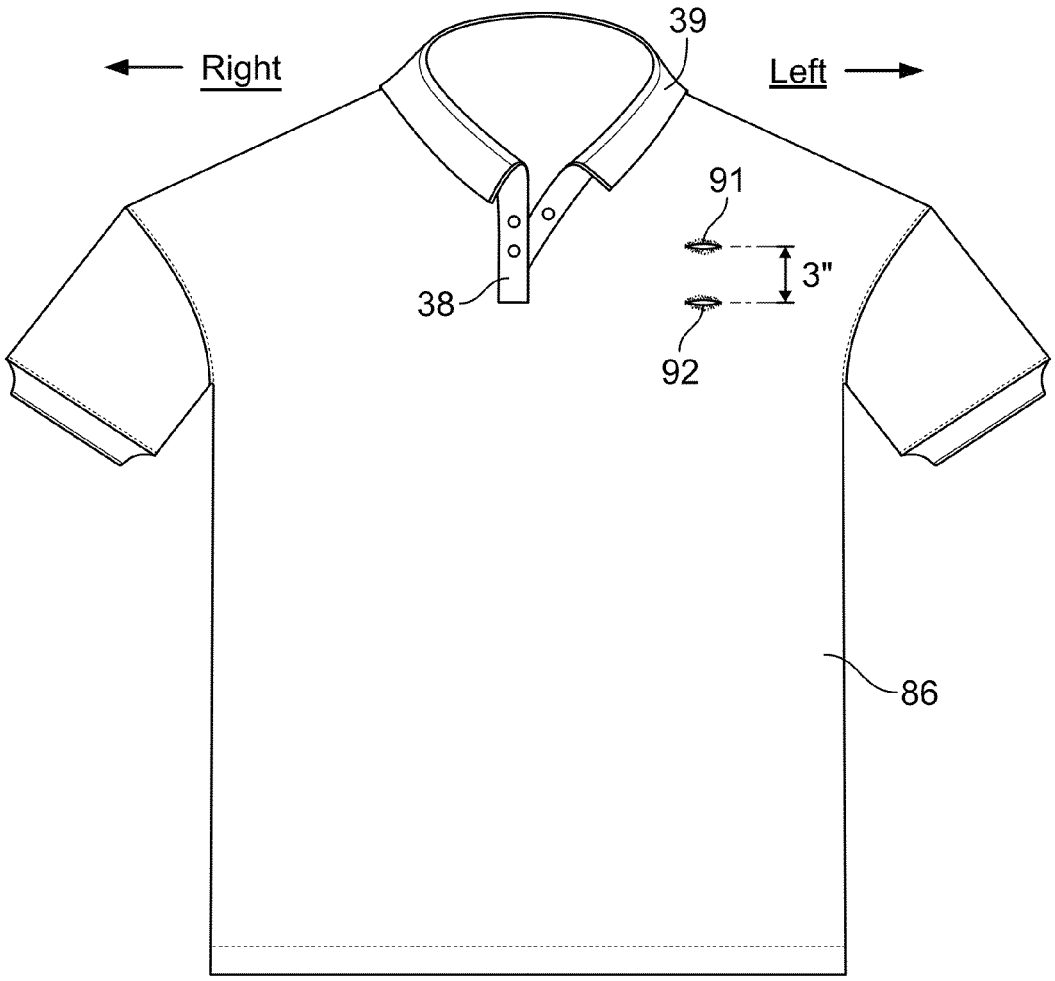
FIG. 9 is an elevation of another embodiment in which two holes are located on a shirt with a collar and placket, the wearer's right is on the left of this drawing.

Throughout these drawings, the specification and claims refer to the shirt wearer's right, as labeled in FIGS. 7, 8, & 9. The shirt wearer's right is on the observer's left side of these drawings.

Angle descriptions will be their common mathematical definitions:

Acute angle is an angle less than 90 degrees.

Right angle is 90 degrees.

Obtuse angle is an angle greater than 90 degrees but less than 180 degrees.

Reflex angle is an angle greater than 180 degrees but less than 360 degrees.

Pocket 7 comprises a piece of fabric 7, stitched by means of stitches 9, to shirt material 5. Pocket 7 has a vertical segment 11, having a width 11W, shown in FIG. 1 as ⅝". At the top of the pocket is a fold 12, the edge 13 of which is shown in dotted lines 13. Fold 12 is stitched to pocket 7 by stitches 14. Top edge 15 is not stitched down to shirt material 5, so that the pocket 7 remains open at the top 15, to receive an eyeglasses temple.

All the remaining edges of the pocket 7 are stitched down securely by stitching 9.

Pocket 7 has a vertical segment 11.

Said vertical segment 11 has a the top edge 15.

Said top edge 15 is not stitched to said clothing.

Said vertical segment 11 has a distal vertical edge 16L, which in this FIG. 1 is a wearer's left vertical edge 16L.

Said distal vertical edge 16L makes a distal right angle 16B to the top edge 15;

Said vertical segment 11 has an endward vertical edge 16R, which in this FIG. 1 is a wearer's right vertical edge 16R.

Said endward vertical edge 16R makes an endward right angle 16A to the top edge 15.

Said left vertical edge 16L is stitched to said clothing; and said right vertical edge 16R is stitched to said clothing.

Said narrow vertical segment 11 has a narrow vertical segment width 11W, shown in FIG. 1 in its presently preferred width of ⅝ inches.

At the bottom of segment 11, is an angle 17, which bounds an earpiece receiving segment or bottom segment 19 of pocket 7, for holding an earpiece of the glasses.

Earpiece or bottom segment 19 has:

an end 21, shown in FIG. 1 as a vertical edge 21 of about 1 inch;

an upper edge 22, approximately 1.5 inches in length; and a bottom edge 25, approximately 2.5 inches in length.

Said end 21, said upper edge 22, and the bottom edge 25, are all stitched to the shirt.

The wider edge 21 allows various earpieces, joined by bend's of varying angles between their inner temples and their ear pieces, to be accommodated by pocket 7.

Angle 27, which is closer to vertical end 21, and which may therefore be referred to as endward angle 27, measured inside the pocket 7, on FIG. 1, between 240 degrees and 250 degrees, between vertical segment 11 and edge 22, is slightly different, larger, than angle 17, which is farther from vertical end 21, and which may therefore be referred to as distal angle 17, measured inside the pocket 7, measured on FIG. 1 between 120 degrees and 130 degrees, to create the widening of segment 19 at end 21. The end 21, said upper edge 22, and the bottom edge 25, are all stitched to the shirt;

The endward vertical edge 16R makes an endward outside obtuse angle 27 to the upper edge 22.

Said distal vertical edge 16L makes a distal inside obtuse angle 17 to the lower edge 25.

The upper edge 22 makes an end inside obtuse angle 23 to the end edge 21.

The end edge 21 makes an end inside acute angle 24 to the bottom edge 25.

The endward outside obtuse angle 27 is smaller than the distal inside obtuse angle 17.

Said bottom segment 19 widens from the narrow vertical segment 11 to the end edge 21, which end edge 21 is larger than the narrow vertical segment width.

Figure 2:
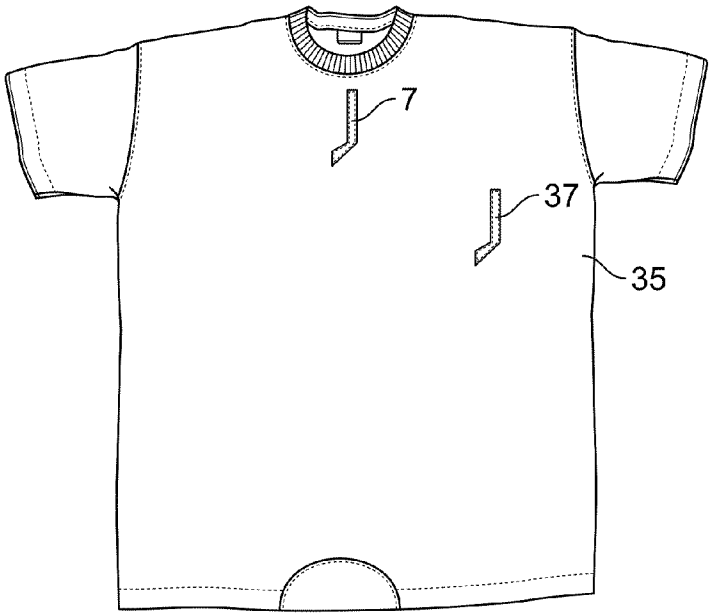
FIG. 2 is an elevation of said pocket stitched onto a T-shirt.

FIG. 2 is an elevation of said pocket 7 stitched onto a T-shirt 35.

Pocket 37, is a similar pocket to pocket 7, but is alternately located, as shown, where a conventional breast pocket would normally be located.

Figure 3:
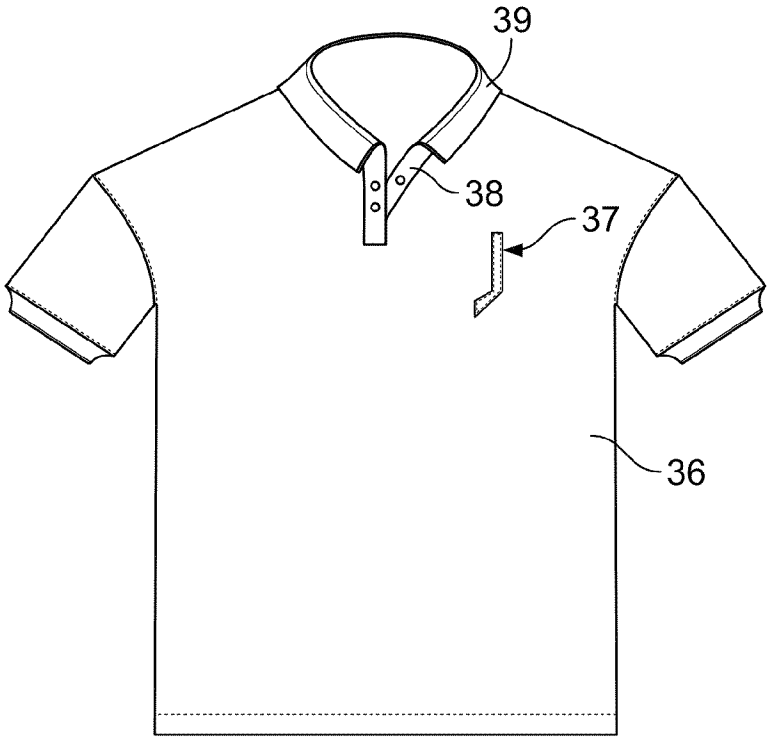
FIG. 3 is an elevation of said pocket stitched onto a shirt with a collar and placket.

FIG. 3 is an elevation a polo-type shirt 36 with a pocket 37 stitched onto said shirt at a breast pocket location. Shirt 36 has a placket 38 and a collar 39. The opening placket 38 makes the breast pocket location of pocket 37 preferable to the center collar location of pocket 7 in FIG. 2.

Figure 4:
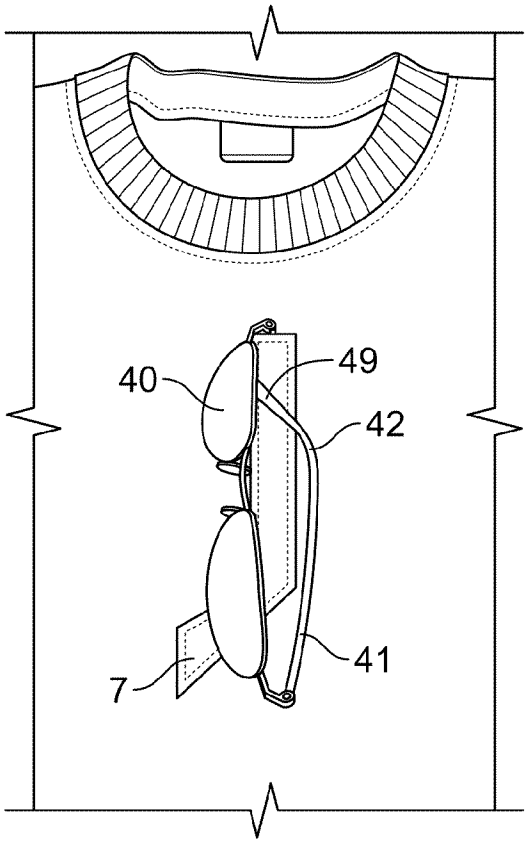
FIG. 4 is an elevation of a detail of FIG. 2 showing a pair of sunglasses held in the pocket by the pair's right temple.

FIG. 4 is an elevation similar to FIGS. 2 & 3, showing a pair of sunglasses 40 held in the pocket 7 by the pair's right temple, which is hidden in the pocket 7.

The counterpart exposed left temple 41 is shown with its bend 42 and earpiece 49.

Figure 5:
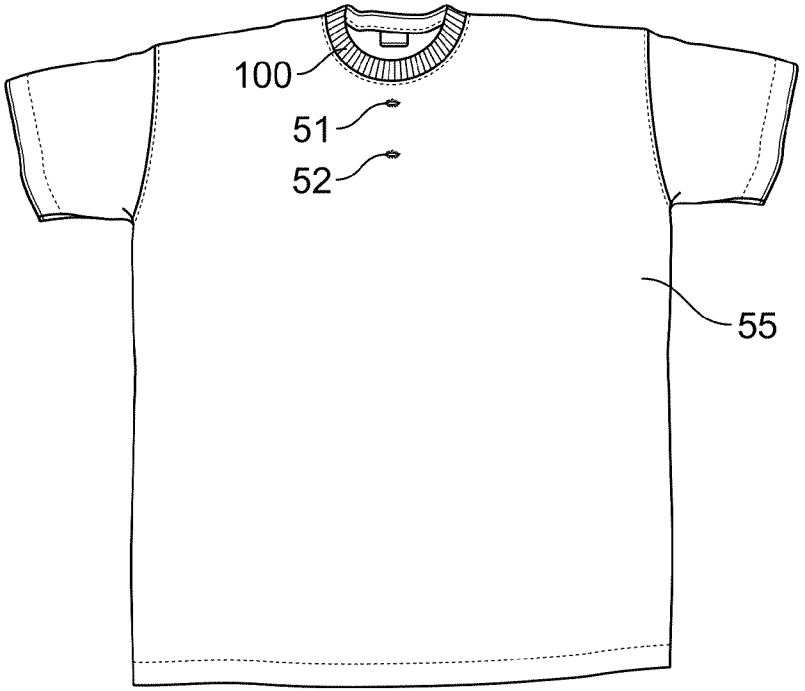
FIG. 5 is an elevation of a second embodiment in which two holes are located on a T-shirt.

FIG. 5 is an elevation of a second embodiment, on which two holes 51-52 are located on a T-shirt 55.

Figure 6:
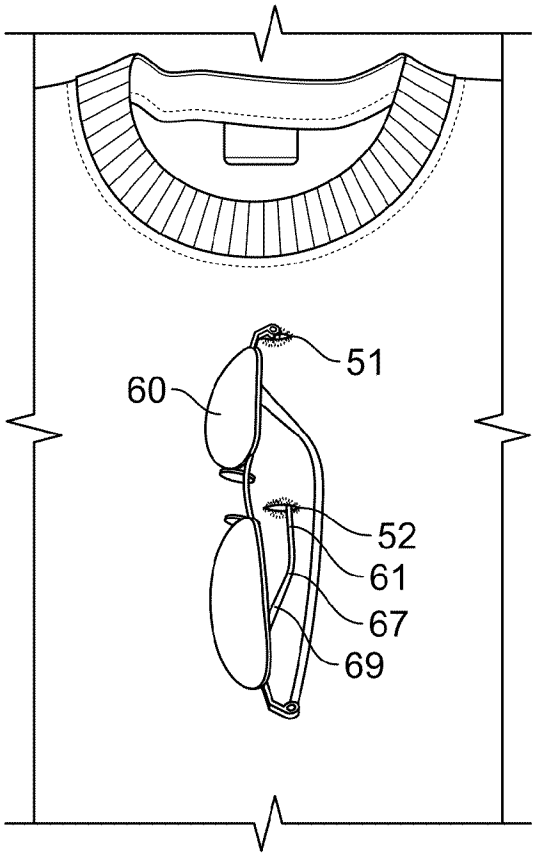
FIG. 6 shows a pair of sunglasses supported by a right temple inserted in the holes of FIG. 5.

FIG. 6 shows a pair of sunglasses 60 supported by a right temple 61 inserted through the holes 51-52 of FIG. 5.

FIG. 7 is a detail of said holes 51-52. Each hole is horizontally oriented, running from a right point such as 53 to a left point 54, on hole 51; and running from a right point 55*a* to a left point 56, on hole 52.

Each hole has an upper edge such as 57 and a lower edge 58, which are preferably formed and reinforced by stitching 57A & 58A along said edges 57 & 58 and cutting between the stitching. The cut forms, on each hole, a preferably ⅝ inch horizontal opening. Hole 51 is located substantially three inches above similarly formed hole 52.

As shown in FIG. 6, this allows a temple 61 to be inserted from above, through hole 51.

Bend 67 of the temple 61 will cooperate with the angled earpiece 69, to retain temple 61 in the holes 51-52. The small holes 51-52 make a more subtle eyeglasses holder.

However, this embodiment does not retain eyeglasses as well as does the preferred embodiment shown in FIGS. 1 through 4, because the pair of open holes 51-52 don't have a pocket segment 19, to snugly hold earpiece 61. Nor do the pair of open holes 51-52 have a stitched narrow vertical segment 11, through which a temple bend must be forced.

A second embodiment of the invention comprises a pair of horizontal holes, constructed like buttonholes, approximately ⅝ inch across their openings, and spaced approximately 3 inches apart. These holes are located in a continuous area of cloth, and supported by said continuous area of cloth.

These holes are not located at an edge of a garment opening, nor are they associated with buttons. These holes are not intended for buttons. However, in construction, the holes are preferably formed in the same way as buttonholes, either by:

conventional edge and corner buttonhole stitching, or old fashioned bindings or hem tapes at the edges and corners.

The continuous area of cloth extends laterally from the holes for at least three inches left and right, to support the holes firmly in the garment.

It is also harder to pocket the temple 61 in this FIG. 7 embodiment, because, after inserting temple 61 through hole 51, there is nothing to guide earpiece 69 to hole 52, and therefore earpiece 69 must be located through hole 52 either carefully, or by successive hopeful stabs.

In an alternate embodiment shown in FIG. 8, panel of cloth 70 may be stitched behind and between the two holes 51-52. The stitching would run from the right point 55*a* of hole 52 up along the stitch line 75 to the right point of hole 51.

Then cloth 70 is secured by stitch line 77 over the top of hole 51 and stitch line 77 goes to the left point 54 of hole 51.

Alternatively, the upper edge could be secured to cloth 70 when the upper edge 57 of button hole 51 is formed by stitching. Or the upper edge of cloth 70 can be left unsecured.

Stitching continues from left point 54, down stitch line 79, to the left point 56 of lower hole 52.

A tab 80 of cloth 70 passes through hole 52 behind hole 52's top edge 81, over hole bottom edge 82 and is stitched down by stitches 78 to shirt 55; or is secured by the stitching that forms the bottom edge 82 of button hole 52.

In this arrangement stitch lines 75 and 79 would guide earpiece 67, from hole 51 down to and through the much more easily located button hole 52.

However this stitched cloth back panel 70 will increase the cost of this embodiment slightly over FIG. 7.

FIG. 9 is an elevation of another embodiment of a shirt 86 with a placket 38 and collar 39. Two holes 91 and 92 are located on shirt 86. Placket 38, makes the breast pocket location of these holes 91-92 preferable to the center collar location in FIGS. 5-6 of T-shirt 55, of holes 51 & 52. The rounded collar 100 of T-shirt 55 (FIG. 5), provides better support for the glasses than does the open placket 38 of FIG. 9.

The breast pocket locations 37 of FIGS. 2-3 are also better for collarless shirts with plackets, that is, a Henley style shirt, not shown.

I claim:

1. Apparatus for temporarily securing a pair of eyeglasses, said eyeglasses having frames, a temple, a bend in the temple, and an earpiece on the temple, said apparatus comprising:

a shirt (5, 35-36);

a pocket (7, 37) affixed to said shirt (5, 35, 36);

said pocket of having a narrow vertical segment (11) the length of the temple; and said pocket having a pair of different angles (17 & 27);

said pair of angles begin a bottom segment (19);

said bottom segment has:

an end (21);

an upper edge (22); and a bottom edge (25);

said vertical segment has a top edge (15);

said top edge is not stitched to said shirt;

said vertical segment has an endward vertical edge (16R);

said endward vertical edge makes an endward right angle (16A) to the top edge;

said vertical segment has a distal vertical edge (16L), distal from the endward vertical edge (16R);

said narrow vertical segment (11) has a narrow vertical segment width (11W);

said distal vertical edge (16L) makes a distal right angle (16B) to the top edge (15);

said endward vertical edge (16R) is stitched to said shirt; and said distal vertical edge (16L) is stitched to said shirt;

said bottom segment (19) widens from the pair of different angles (17 & 27) to the end (21), at which end (21) said bottom segment is wider than the narrow vertical segment width (11W);

said end (21), said upper edge (22), and the bottom edge (25), are all stitched to the shirt;

said endward vertical edge (16R) makes an endward outside obtuse angle (27) to the upper edge (22);

said distal vertical edge (16L) makes a distal inside obtuse angle (17) to the bottom edge (25);

the upper edge (22) makes an end inside obtuse angle (23) to the end (21);

the end (21) makes an end inside acute angle (24) to the bottom edge (25); and the endward outside obtuse angle (27) is smaller than the distal inside obtuse angle (17).

2. Apparatus according to claim 1 in which:

said shirt is made of cloth;

said pocket (7) is cloth;

said pocket is secured to said shirt by stitches.

3. Apparatus according to claim 2 in which:

the narrow vertical segment (11), has a bottom (27 to 17);

said bottom is between three and four inches from the top edge;

said distal vertical edge is between 0.5 and 1 inches from the endward vertical edge.

4. Apparatus according to claim 3 in which:

said bottom is 3.5 inches from the top edge;

said distal vertical edge is ⅝ inches from the endward vertical edge; and the vertical segment width is ⅝ inches.

5. Apparatus according to claim 4 in which:

the end is vertical edge (21);

said end (21), said upper edge (22), and the bottom edge (25), are all stitched to the clothing.

6. Apparatus according to claim 5 in which:

the end (21) is in a range from 0.75 to 1.3 inch;

the upper edge (22), is in a range from 1.1 to 1.8 inches in length; and the bottom edge (25), is in a range from 2.1 to 2.8 inches in length.

7. Apparatus according to claim 6 in which:

the end (21) is 1 inch;

the upper edge (22), is 1.5 inches in length; and the bottom edge (25), is 2.5 inches in length.

8. Apparatus according to claim 5 in which:

the endward outside obtuse angle (27) is smaller than the distal inside obtuse angle (17);

to create the widening of said bottom segment (19) at said end (21), which widening cooperates with various of the earpieces, joined by bends of varying angles between the inner temples and the ear pieces, for said various ear pieces to be accommodated and retained by the pocket (7).

9. Apparatus according to claim 1 in which:

the shirt is a T-shirt; and said T-shirt has a buttonless neck; and the pocket is located centrally at and below the neck.

10. Apparatus according to claim 1 in which:

the shirt is a shirt having a placket; and the pocket is located over a breast, where a conventional breast pocket would normally be located.

* * * * *